United States Patent [19]

Quest

[11] Patent Number: 5,050,267

[45] Date of Patent: Sep. 24, 1991

[54] ELECTRICAL CABLE ACCESS GROMMET

[76] Inventor: Thomas A. Quest, 906 S. 117th Ct., Omaha, Nebr. 68154

[21] Appl. No.: 576,364

[22] Filed: Aug. 31, 1990

[51] Int. Cl.[5] ..... H02G 3/22; F16L 5/00

[52] U.S. Cl. ..... 16/2; 174/48; 312/223

[58] Field of Search ..... 174/48, 65 G, 152 G, 174/153 G; 16/2; 248/56; 312/223; 379/438; D8/356, 400

[56] References Cited

U.S. PATENT DOCUMENTS

| | | | |
|---|---|---|---|
| D. 268,895 | 5/1983 | Beleckis | D8/400 |
| D. 296,761 | 7/1988 | Mockett | D8/400 |
| 3,857,136 | 12/1974 | Dean | 16/2 |
| 4,520,976 | 6/1985 | Cournoyer et al. | 248/56 |
| 4,730,363 | 3/1988 | Asbaghi | 16/2 |
| 4,828,513 | 5/1989 | Morrison et al. | 312/223 |

FOREIGN PATENT DOCUMENTS

| | | | |
|---|---|---|---|
| 3037084 | 5/1982 | Fed. Rep. of Germany | 312/223 |

*Primary Examiner*—Laramie E. Askin
*Attorney, Agent, or Firm*—George R. Nimmer

[57] ABSTRACT

For protectively and aesthetically surroundably lining various sizes of office furniture rectangular openings for upwardly emergent electrical cords, there is provided an apt and unusually readily universally installable escutcheon grommet. The escutcheon grommet has two transversely extending end-panels for abuttable attachment to two opposed upright-ends of the furniture opening and each is centrally provided with an end-ledge, has a longitudinally extending and cross-sectionally regular rear-panel of selectable length and which is abuttable at a third end of the furniture opening and which is removably attachable to the end-panels, and has a cover-plate removably restable upon the end-ledges and rear-panel and having a convex fore-end for non-chafably confronting the upwardly emergent electrical cords. If the office furniture rectangular opening has a tangibly fully-closed fourth end, there is a grommet front-panel thereat and provided with a convex trailing-face so that the upwardly emergent electrical cord or cords are locatable in non-chafing condition between the cover-plate fore-end and the front-panel trailing-face.

6 Claims, 3 Drawing Sheets

FIG. 1
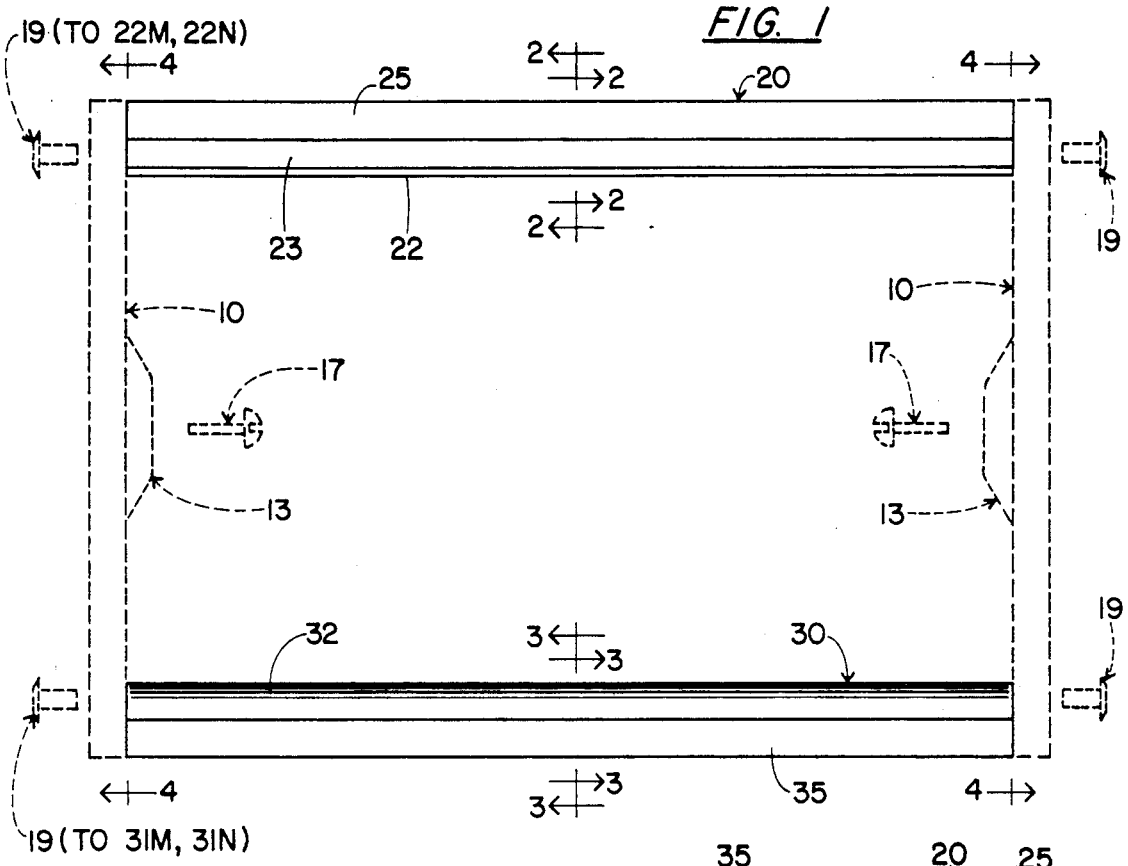
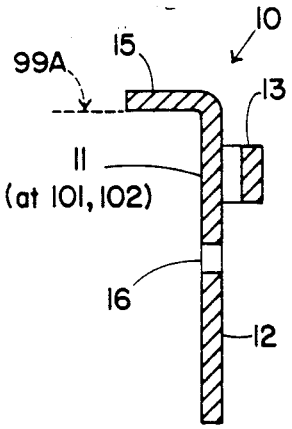
FIG. 6
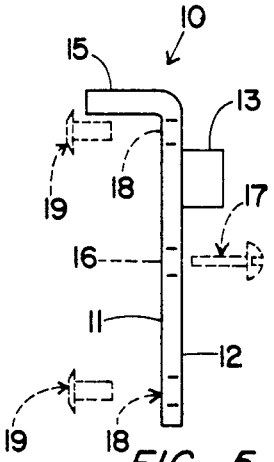
FIG. 5
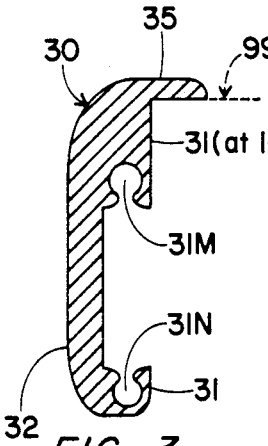
FIG. 3
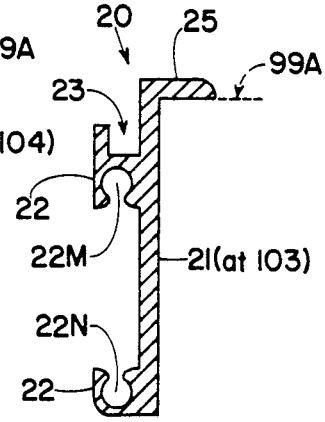
FIG. 2
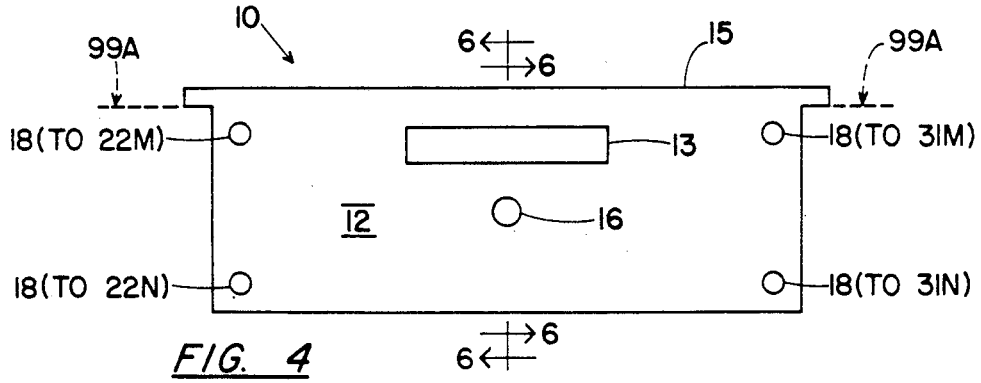
FIG. 4

99A
9
99
23
41
10
15
13
(11, 101)
17
9
43
98
23
32
8
8
22
40
30
20
100
42
(21, 103)
(31, 104)
9
41
15
(11, 102)
23
9
10
13
17

ELECTRICAL CABLE ACCESS GROMMET

BACKGROUND OF THE INVENTION

Electrical cord access grommets employed as escutcheon (e.g. peripheral lining) for openings within office furniture are disclosed in U.S. Pat. No. DES.268,895 (May 10, 1983), U.S. Pat No. DES296,761 (Jul. 19, 1988), and in their cited prior art. Such escutcheon grommets are intended to aesthetically protectively line the office furniture opening and to provide a compact, non-chafing surrounding environment for electrical cord extending upwardly through the furniture opening. Because many such office furniture openings are of rectangular shape, but of varying dimensions, it is an exceedingly expensive proposition to inventory various dimensional sizes of escutcheon grommets necessary for lining furniture openings.

OBJECTIVE OF THE INVENTION

It is accordingly the general objective of the present invention to provide electrical cord access grommets employable as escutcheon linings for the dimensions of a rectangular opening of office furniture and which rectangular escutcheon grommet is provided with a cover-plate ensuring that electrical cord extending upwardly through the furniture opening is compactly surrounded in non-chafed condition thereby. It is an ancillary general objective to provide cross-sectionally uniform and readily attachable panel components for a grommet whereby it can be sized at situs to coform to the dimensions of the furniture rectangular opening to be lined therewith.

GENERAL STATEMENT OF THE INVENTION

With the above general and ancillary objectives in view, and together with other related and specific objectives which will become more apparent as this description proceeds, the electrical cable access grommet concept of the present invention generally comprises: a pair of upright and transversely extending end-panels respectively having an upright lead-face for confronting an end of the furniture opening, an upright trail-face provided with an end-ledge, and an end-flange for downwardly resting upon the office furniture; a longitudinally extending rear-panel of selectable length and removably attachable to the end-panels. The rear-panel having an upright leadward-face for confronting an elongated end of the furniture opening, having a side-ledge, and having a side-flange for downwardly resting upon the office furniture; and a cover-plate removably resting upon the two end-ledges and the side-ledge and having a convex fore-end so that at least one vertically extending electrical cable is locatable externally of the cover-plate fore-end in non-chafable condition. Ancillary to office furniture rectangular openings having a tangibly fully-closed fourth end, the grommet also includes a longitudinally extending front-panel constructed and employed analogously with the rear-panel and also being provided with a convex trailing-face confronting and spaced from the cover-plate convex fore-end whereby said convey fore-end and trailing-face compactly and non-chafably accommodate electrical cable therebetween.

BRIEF DESCRIPTION OF THE DRAWING

In the drawing,

FIG. 1 in solid lines depicts top plan views of a rear-panel component 20 and an optional front-panel component 30 for the electrical cable access grommets of the present invention. FIG. 1 in phantom lines depicts, inter alia, top plan views of the two end-panel components 10 for the electrical cable access grommets of the present invention;

FIG. 2 is a sectional elevational view of the rear-panel component, taken along lines 2—2 of FIG. 1;

FIG. 3 is a sectional elevational view of the front-panel component, taken along line 3—3 of FIG. 1;

FIG. 4 is a side elevational view of the FIG. 1 end-panels components;

FIG. 5 is an end elevational view of the FIG. 1 end-panels components;

FIG. 6 is a sectional elevational view taken along lines 6—6 of FIG. 4.

DETAILED DESCRIPTION OF THE DRAWING

Figure 7:
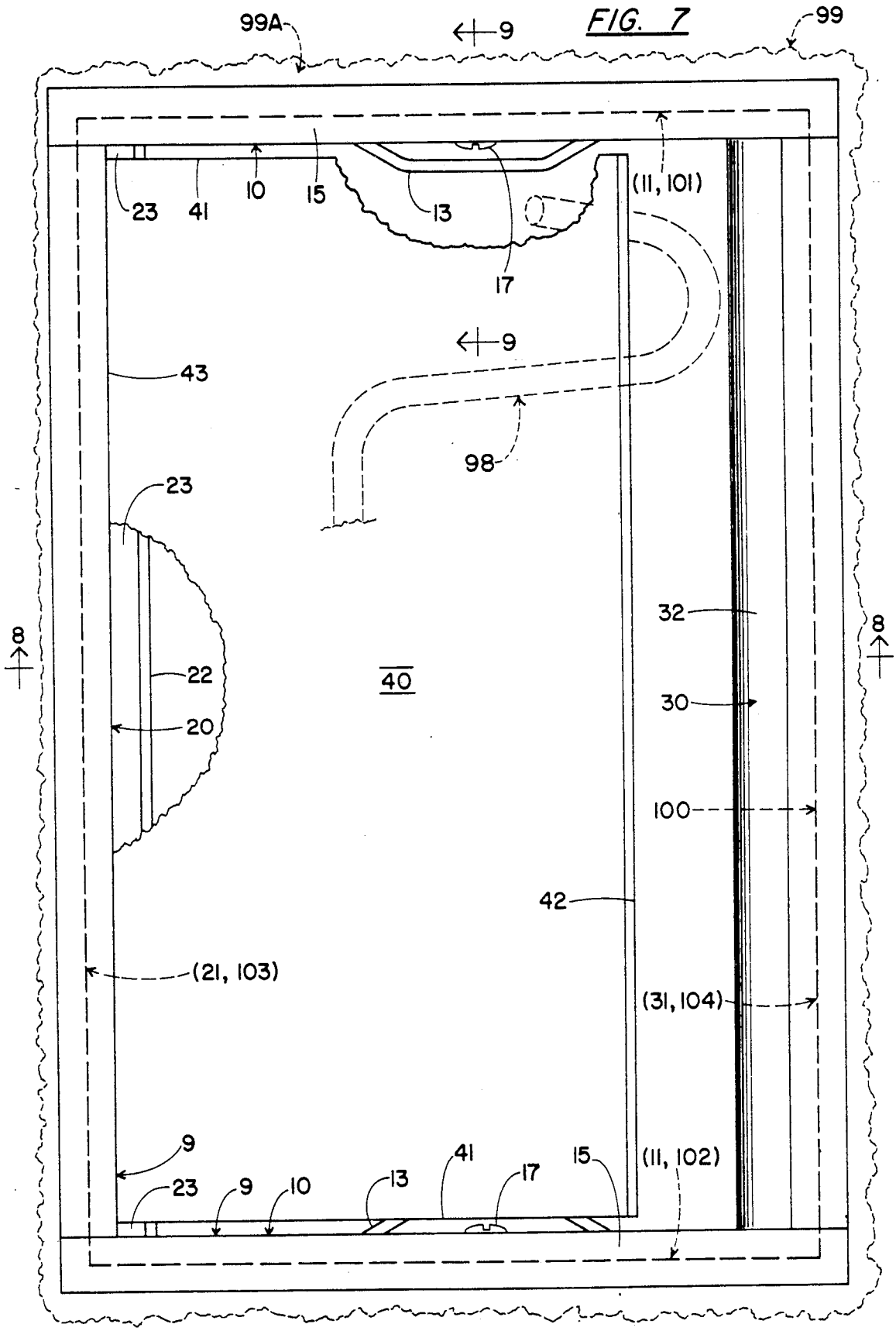
FIG. 7 is a top plan view of a representative embodiment 9 of the electrical cable access grommet of the present invention and shown intalled within an opening in 100 selectable office furniture 99.

Turning initially to drawing FIGS. 1–6, there is depicted the rear-panel component 20, the two end-panels components 10, and the optional front-panel component 30 of the electrical cable access grommets (e.g. 9) of the present invention.

Each end-panel component 10 comprises an upright lead-face 11 for abuttably confronting an upright-end 101, 102 of a vertically extending opening 100 through office furniture 99 having an upper surface 99A. Each end-panel component 10 also comprises an upright trail-face 12 that is centrally provided with a horizontally extending end-ledge 13. Located above end-ledge 13 and in angular relationship to said lead-face 11 is a horizontal end-flange 15 adapted to downwardly rest upon office furniture horizontal upper surface 99A. Each end-panel immediately below its end-ledge 13 is centrally horizontally apertured 16 to accommodate a horizontal screw fastener 17 for fastening to a furniture opening upright-end 101, 102. At its two upright termini, each end-panel is provided with a pair of horizontal apertures 18 therethrough, to accommodate pop-rivet fasteners 19.

Rear-panel 20 has two longitudinally separated ends for abuttably confronting the trial-face 12 of each end-panel 10 and removably attached thereto with four fasteners 19 passing through the four apertures 18 of the end-panels. Rear-panel 20 comprises an upright leadward-face 21 for abuttably confronting another upright-side 103 of furniture rectangular opening 100. Rear-panel 20 also comprises an upright trailward-face 22 provided longitudinally therealong with a generally horizontal and downwardly angular side-ledge 23. At each terminus and alignable thereat with two end-panel apertures 18, rear-panel trailward-face 22 is contoured with recesses 22M and 22N to accommodate two fasteners 19 thereat. Located above side-ledge 23 and in angular relationship to leadward-face 21, rear-panel 20 includes a horizontal side-flange 25 adapted to downwardly rest upon office furniture upper surface 99A.

Optionally employable front-panel 30 has two longitudinally separated ends for abuttably confronting the trail-face 12 of each end-panel 10 and removably attached thereto by fasteners 19 passing through the remaining four apertures 18 of the end-panels. Front-panel 30 has an upright leading-face 31 for abuttably confronting another (if present) upright-side 104 of furniture rectangular opening 100. At each terminus and alignable thereat with two end-panel apertures 18, front-panel leading-face 31 is contoured with recesses 31M and 31N to accommodate two fasteners 19 thereat. Front-panel 30 also comprises a horizotal side-flange 35 adapted to downwardly rest upon office furniture upper surface 99A. Front-panel 30 also comprises a linearly generated, uprightly convex, trailing-face 32. As will be explained later in greater detail, a front-panel 30 is necessary only when the furniture vertical opening 100 has four tangible upright ends 101–104 and is unnecessary when the furniture vertical opening to be lined by the grommet has three tangible upright ends 101–103 and an imaginary or "open" fourth end.

Figure 8:
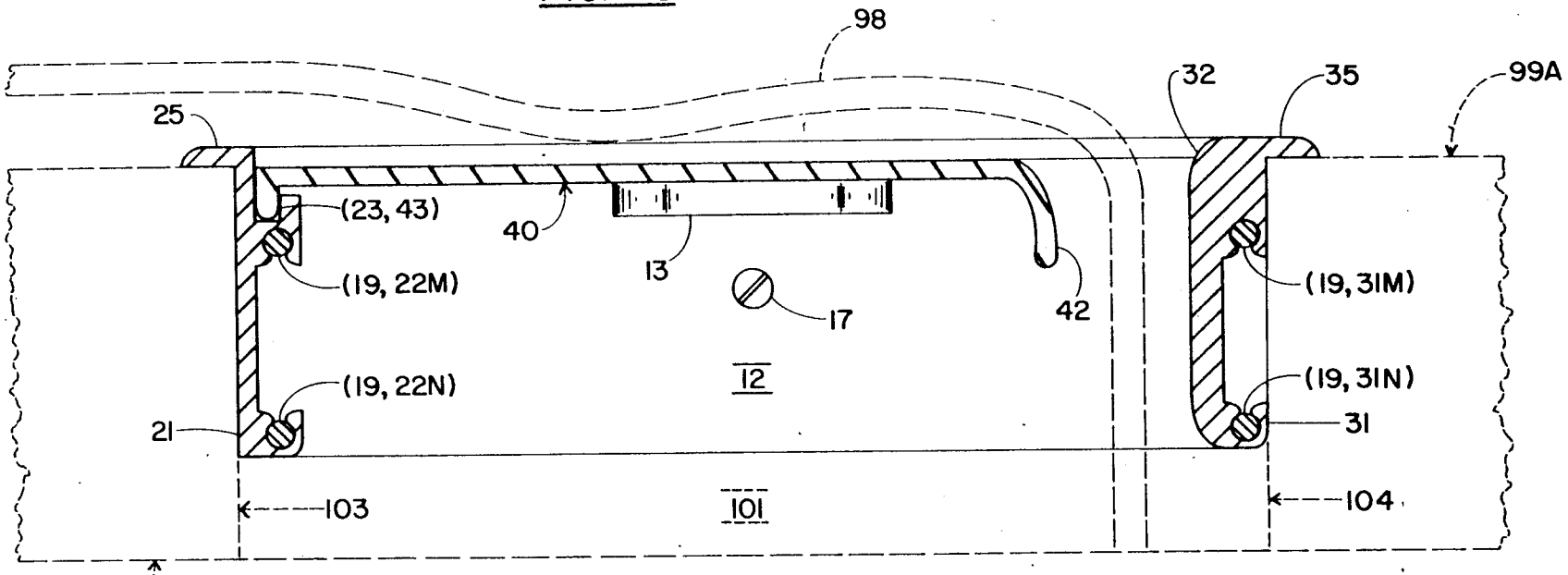
FIG. 8 is a sectional elevational view taken along line 8—8 of FIG. 7.
Figure 9:
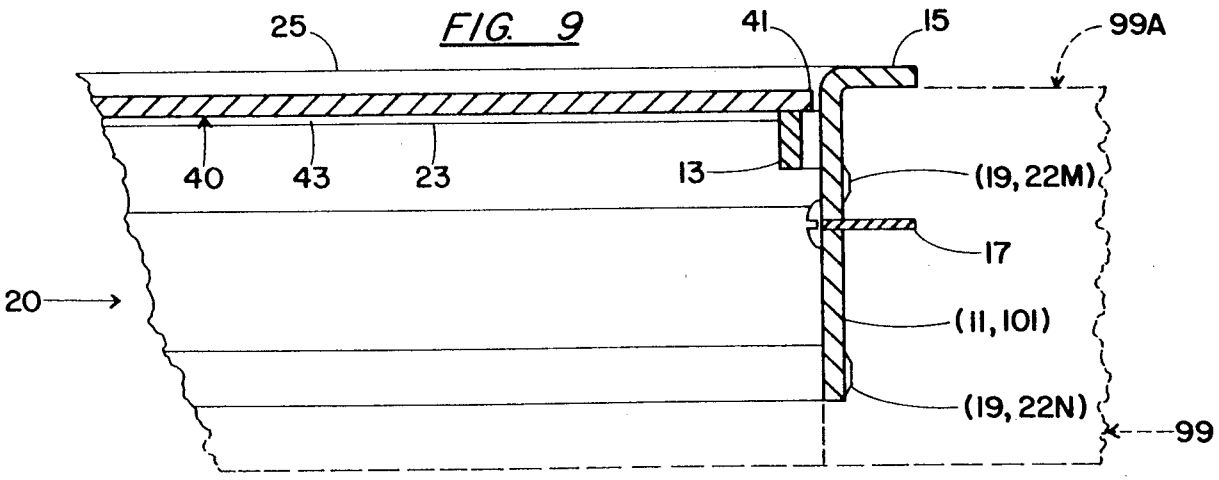
FIG. 9 is a sectional elevational view taken along line 9—9 of FIG. 7.

As indicated hereabove and in drawing FIGS. 7–9, these primary components 10, 10, 20, and 30 are thusly attached with eight endward fasteners 19 into a representative embodiment 9 of the electrical cable access grommet, and which embodiment 9 also includes a removably positioned cover therefor. Accordingly:

(A) lead-faces 11 of the end-panels abut two of the furniture opening ends 101 and 102, respectively, and end-panels 10 are attached thereat with fasteners 17;

(B) rear-panel leandward-face 21 abuts furniture opening end 103;

(C) front-panel leading-face 31 abuts furniture opening and 104; and (D) horizontal cover-plate 40 at its transversely extending plate-ends 41 rests upon co-planar end-ledges 13, at its upright aft-end 43 extends into rear-panel side-ledge 23, and at its linearly generated convex fore-end 42 is parallel to but separated from front-panel trailing-face 32.

Thus, one or more electrical cables 98, located within furniture opening 100, are upwardly extendable in non-chafed condition between the opposed and linearly generated convex surfaces 32 and 42.

Fabrication of grommet embodiment 9 includes the following procedural steps;

(i) measuring the longitudinal length 103, 104 of the rectangular furniture opening 100, and severing matching lengths from infinitely lengthy lengths of cross-sectionally uniform rear-panel (20) and front-panel 30;

(ii) at both termini of rear-panel 20, namely at longitudinally extending recesses 22M and 22N, utilizing fasteners 19, passing through apertures 18 of the end-panels, so as to attach the end-panels 10 to rear-panel 20; and also (iii) at both termini of front-panel 30, namely at longitudinally extending recesses 31M and 31N, utilizing four additional fasteners 19, respectively passing through four remaining apertures 18 of the end-panels, to thereby also attach end-panels 10 to front-panel 30.

For these furniture openings located at the furniture extremity (i.e. has three upright ends 101–103 and an imaginary open-end), end-panels 10 and rear-panel 20 are necessary along opening upright ends 101–103, respectively, but a front-panel 30 is unnecessary along the furniture opening imaginary open-end. In the latter regard, for a grommet embodiment not including a front-panel 30, one or more electrical cables 98, located within a furniture opening, are upwardly extendable in non-chafed condition between the cover convex fore-end and the imaginary open-end of the furniture opening.

From the foregoing, the construction and operation of the electrical cable access grommets of the present invention will be readily understood and further explanation is believed to be unnecessary. However, since numerous modifications and changes will readily occur to those skilled in the art, it is not desired to limit the invention to the exact constructions shown and described, and accordingly, all suitable modifications and equivalents may be resorted to, falling within the scope of the appended claims.

I claim:

1. Electrical cable access grommet for use in office furniture having a rectangular opening through which at least one electrical cable extends vertically therethrough, said furniture rectangular opening including a pair of directionally longitudinally extending upright-sides and a pair of directionally transversely extending upright-ends, said electrical cable access grommet comprising:

(A) a pair of upright and transversely extending end-panels, each having a similar finite transverse-length, and comprising:

(Ai) an upright lead-face for uprightly confronting a rectangular opening upright-end, (Aii) an upright trail-face provided with a horizontally extending end-ledge, (Aiii) located above said end-ledge and in an angular relationship to said lead-face, and end-flange adapted to downwardly rest upon said office furniture, and (Aiv) said end-panel below said end-ledge being apertured to accommodate a horizontally extending fastener for fastening to said rectangular opening upright-end;

(B) a longitudinally extending upright rear-panel confronting the trail-faces of the two end-panels and removably attached thereto, said rear-panel comprising:

(Bi) an upright leadward-face for uprightly confronting a rectangular opening upright-side, (Bii) an upright trailward-face provided with a horizontally extending side-ledge, and (Biii) located above said side-ledge and in an angular relationship to said leadward-face, a side-flange adapted to downwardly rest upon said office furniture; and (C) a horizontal, rectangular, and removably positioned cover-plate comprising:

(Ci) a pair of transversely extending plate-ends, each plate-end having a transverse-extent less than said transverse-length and resting downwardly upon a said end-ledge, (Cii) a longitudinally extending aft-end resting downwardly upon said side-ledge, and (Ciii) a linearly generated, upright, longitudinally extending fore-end, whereby said at least one vertically extending electrical cable is locatable adjacently externally of said fore-end.

2. The electrical cable access grommet of claim 1 wherein there is a longitudinally extending upright front-panel confronting the trail-faces of the two end-panels and removably attached thereto, said front-panel comprising: an upright leading-face for uprightly confronting the remaining upright-side of said furniture rectangular opening; a side-flange in angular relationship to said leading-face and adapted to downwardly rest upon said office furniture; and an upright trailing-face spaced transversely away from said cover-plate fore-end, whereby said two end-flanges and said two side-flanges provide an escutcheon for said office furniture rectangular opening and the said at least one vertically extending electric cable is locatable between the cover-plate fore-end and the front-panel.

3. The electrical cable access grommet of claim 2 wherein the rear-panel trailward-face in confrontation with the two end-panels is contoured to receive a pin-type attachment means extending between the rear-panel and the two end-panels; and wherein the front-panel trailing-face in confrontation with the two end-panels is contoured to recieve a pin-type attachment means extending between the front-panel and the two end-panels.

4. The electrical cable access grommet of claim 3 wherein the cover-plate fore-end is of convex linearly generated contour.

5. The electrical cable access grommet of claim 1 wherein the rear-panel trailward-face in confrontation with the two end-panels is contoured to receive a pin-type attachment means extending between the rear-panel and the two end-panels.

6. The electrical cable access grommet of claim 5 wherein the cover-plate fore-end is of convex linearly generated contour.

* * * * *